US007790018B2

(12) United States Patent
Khan

(10) Patent No.: US 7,790,018 B2
(45) Date of Patent: Sep. 7, 2010

(54) METHODS FOR MAKING HIGHER VALUE PRODUCTS FROM SULFUR CONTAINING CRUDE OIL

(75) Inventor: Rashid M. Khan, Dhahran Camp (SA)

(73) Assignee: Saudia Arabian Oil Company (SA)

( * ) Notice: Subject to any disclaimer, the term of this patent is extended or adjusted under 35 U.S.C. 154(b) by 787 days.

(21) Appl. No.: 11/431,323

(22) Filed: May 10, 2006

(65) Prior Publication Data

US 2006/0254956 A1 Nov. 16, 2006

Related U.S. Application Data

(60) Provisional application No. 60/679,903, filed on May 11, 2005.

(51) Int. Cl.
*C10G 45/00* (2006.01)

(52) U.S. Cl. ..... 208/89; 208/57; 208/212; 208/215

(58) Field of Classification Search ..... 208/108, 208/208 R, 209, 211, 212, 215, 216 R, 217, 208/89, 57
See application file for complete search history.

(56) References Cited

U.S. PATENT DOCUMENTS

| | | | | |
|---|---|---|---|---|
| 3,944,481 | A | 3/1976 | Wing et al. | |
| 4,927,522 | A * | 5/1990 | Herbst et al. | 208/120.01 |
| 5,104,516 | A | 4/1992 | de Bruijn et al. | |
| 5,322,617 | A | 6/1994 | de Bruijn et al. | |
| 5,382,349 | A * | 1/1995 | Yoshita et al. | 208/49 |
| 5,389,230 | A | 2/1995 | Veluswamy | |
| 5,578,197 | A | 11/1996 | Cyr et al. | |
| 5,851,381 | A * | 12/1998 | Tanaka et al. | 208/210 |
| 5,935,419 | A | 8/1999 | Khan et al. | |
| 6,059,957 | A | 5/2000 | Khan et al. | |

(Continued)

FOREIGN PATENT DOCUMENTS

| | | |
|---|---|---|
| GB | 1 488 227 | 10/1977 |

OTHER PUBLICATIONS

Fitzpatrick, Rebecca Lyn. "Novel Applications of Carbon Fiber for Hot Mix Asphalt Reinforcement and Carbon-Carbon Pre-forms", 2000 (no month), MS Thesis, Michigan Technological University, pp. 1-10.*

(Continued)

*Primary Examiner*—Walter D Griffin
*Assistant Examiner*—Renee Robinson
(74) *Attorney, Agent, or Firm*—Bracewell & Giuliani LLP

(57) ABSTRACT

A process for upgrading, or refining, high sulfur containing heavy hydrocarbon crude oil to a lighter oil having a lower sulfur concentration and, hence a higher value product, is disclosed. The process includes reacting the high sulfur heavy hydrocarbon crude oil in the presence of a catalyst and low pressure hydrogen to produce a reaction product stream from which the light oil is recovered. Part of the reaction product is separated and subjected to further upgrading to produce a lower sulfur oil product for application as distillate fuels. The upgrading process also produces residual oil that is suitable for making olefins, carbon fiber or road asphalt. Catalysts utilized in the processes of the invention can include a transition metal containing compound, the metal being selected from Group V, Group VI, and Group VIII of the Periodic Table, and mixtures of these metals.

33 Claims, 1 Drawing Sheet

U.S. PATENT DOCUMENTS

| | | | | |
|---|---|---|---|---|
| 6,418,724 | B1 * | 7/2002 | Cheng | 60/775 |
| 6,835,303 | B2 * | 12/2004 | Mahajan | 208/208 R |
| 6,866,010 | B2 | 3/2005 | May | |
| 6,881,235 | B2 | 4/2005 | May | |
| 6,986,327 | B2 | 1/2006 | May | |
| 2003/0000867 | A1 * | 1/2003 | Reynolds | 208/89 |
| 2003/0194366 | A1 * | 10/2003 | Srinivas et al. | 423/230 |
| 2005/0188841 | A1 | 9/2005 | Khan | |

OTHER PUBLICATIONS

Genck, Wayne J. et al, "Liquid-Solid Operations and Equipment", Perry's Chemical Engineer's Handbook, 8th Edition, Section 18, 2008 (no month), McGraw-Hill.*

Atiemo-Obeng, Victor et al, Handbook of Industrial Mixing, Chapter 8—Rotor-Stator Mixing Devices, 2004 (no month), John Wiley & Sons, pp. 479-480.*

PCT International Search Report and Written Opinion of the International Searching Authority, Nov. 13, 2006, 1-16, European Patent Office, Netherlands.

State Intellectual Property Office, P.R. China, First Office Action, Dated Jun. 10, 2010, Patent Application No. 200680024296.4, Application Dated May 11, 2006.

* cited by examiner

METHODS FOR MAKING HIGHER VALUE PRODUCTS FROM SULFUR CONTAINING CRUDE OIL

RELATED APPLICATION

This application claims priority to U.S. Provisional Application Ser. No. 60/679,903 filed May 11, 2005.

BACKGROUND OF THE INVENTION

1. Field of the Invention

The present invention is generally related to processing of high density high sulfur or heavy hydrocarbon crude oil. More specifically, the invention pertains to an improved process for upgrading a heavy hydrocarbon crude oil feedstock into an oil that is less dense or lighter and contains lower sulfur than the original heavy hydrocarbon crude oil feedstock while making value added materials such as olefins and aromatics.

2. Description of Related Art

The invention generally relates to a process for treating a heavy hydrocarbon crude oil, also referred to herein as "crude oil." More particularly, the process described herein is directed to upgrading a heavy hydrocarbon crude oil feedstock by a hydroprocessing catalyst assisted hydrotreatment. Although the term hydrocracking is often applied to these types of processes, the term hydroconversion (or hydroprocessing or hydrotreatment) will be used herein to avoid confusion with conventional gas oil hydrocracking.

Heavy crude oils are composed chemically of a very broad range of molecules differing widely in molecular weight (MW) and chemical properties. In addition, heavy crude oils from different formations and locations around the world have different characteristics. Because of the large number of variable characteristics of heavy crude oil around the world, it is difficult to define heavy crude oils simply in terms of individual molecular components. Instead, various separation procedures are used to break down the feed into a number of smaller fractions that are more consistently identifiable. One such technique involves separation into solubility classes using solvents of varying polarity and further separation using column chromatography. These fractions can then be further characterized in terms of an average structure by nuclear magnetic resonance (NMR) or other analytical technique known to persons skilled in the art.

Despite the fact that heavy crude oils range widely in their composition and physical and chemical properties, they are typically characterized by having a relatively high viscosity, high boiling point, high Conradson carbon residue, low API gravity (generally lower than 25), and high concentration of sulfur, nitrogen, and metallic impurities. Additionally, the hydrogen to carbon ratio of heavy crude oils is lower than desirable. Further, much of the crude oil around the world also contains relatively high concentration of sulfur. As used herein, the term crude oil, or heavy crude oil, is understood to include heavy hydrocarbon crude oil, tar sands, bitumen, and residual oils, i.e., bottom of the barrel or vacuum bottom oils.

Broadly speaking, heavy crude oils consist of paraffins, cycloparaffins (naphthenes), and aromatics of various ring sizes and degree of aliphatic chain substitution, polarity, and sulfur and nitrogen containing heterocycles content. The molecular weights of heavy crude oils range upward to many thousands of daltons and the boiling points reach 700° C. or more. Most crude oils are believed to be colloidal systems with micelles of high MW polar components (asphaltenes) stabilized by components of intermediate polarity (resins).

The asphaltene components contain most of the metals (V, Ni and Fe) complexed by polydentate N and S ligands such as porphyrins.

In the last two decades, environmental and economical considerations have required the development of processes to remove heteroatom such as, for example, sulfur, nitrogen, oxygen, and metallic impurities, from the heavy hydrocarbon crude oil feedstocks; and, to convert the heavy hydrocarbon crude oil feedstocks to lower their boiling points. Such processes generally subject the heavy hydrocarbon crude oils or their fractions to thermal cracking or hydrocracking to convert the fractions having higher boiling points to fractions having lower boiling points, optionally followed by hydrotreating to remove the heteroatoms.

The main features of all hydroconversion processes are similar. Heavy crude oil feedstock is preheated, mixed with hydrogen at pressure, and passed into a reactor kept at reaction temperature. Sometimes part or all of the hydrogen is added directly to the reactor. The residence time of liquid in the reactor can typically range from 1 to 10 hours.

The hydroprocessed products then pass into a series of one or more vapor/liquid separators. Typically, a hot high-pressure separator removes heavy liquid containing pitch and the vapour passes to a cold high-pressure separator to disengage gases from distillate product. Intermediate separators can be employed to reduce temperature and pressure in stages. In some processes, a vapor phase hydrogenation unit is used to further treat the vapour before passing into the cold separator. Gas from the cold separator is then sent to a scrubber or PSA unit to remove $H_2S$ and $NH_3$ and light hydrocarbons (which is used as fuel gas) and the hydrogen gas is then recycled to the reactor. Fresh hydrogen, usually produced by steam reforming of methane, is added to make up for the hydrogen consumed.

Technologies for upgrading heavy crude oil, including bitumen and residual oils, to give lighter and more useful oils and hydrocarbons can be broadly divided into two types of processes: carbon rejection processes and hydrogen addition processes. Both of these processes employ high temperatures (usually greater than 400° C.) to "crack" the long chains or branches of the hydrocarbons that make up the heavy hydrocarbon crude oil. In the carbon rejection process, the heavy hydrocarbon crude oil is converted to lighter oils and coke. In some carbon rejection processes, the coke is used elsewhere in the refinery to provide heat or fuel for other processes.

Hydrogen addition processes involve reacting heavy crude oils with an external source of hydrogen resulting in an overall increase in hydrogen to carbon ratio. One benefit of hydrogen addition processes compared to carbon rejection processes is that, in the hydrogen addition process, formation of coke is prevented through the addition of high pressure hydrogen. Examples of hydrogen addition processes include: catalytic hydroconversion (hydrocracking) using active HDS catalysts; fixed bed catalytic hydroconversion; ebullated catalytic bed hydroconversion; thermal slurry hydroconversion (hydrocracking); hydrovisbreaking; and hydropyrolysis.

The main goal of upgrading heavy crude oils is to decrease the molecular weight of large molecules to produce components with boiling points and hydrogen to carbon ratios suitable for liquid fuels. At the same time, contaminants such as sulfur, nitrogen, and metals must be removed and the aromatics saturated. Generally, these different "steps" of upgrading require different processes and processing conditions to achieve the desired properties. For instance, hydrogenation of aromatics is best carried out at moderate temperatures with metal catalysts in the absence of sulfur and nitrogen compounds, while removal of sulfur and nitrogen uses metal sulfide based HDS catalysts that need sulfur and function at higher temperatures. Therefore, the overall process generally involves numerous steps for separation of the heavy crude oil into chemically different components and treating them by the most suitable process for each step. However, economic constraints restrict the use of this approach. Therefore, the only separation normally carried out is distillation to remove light fractions or solvent deasphalting to eliminate asphaltenes. For the reasons discussed herein, the present invention is believed to overcome these economic constraints.

Upgrading heavy oil and residual oils results in formation of free radical chain reactions. Free radicals are highly reactive intermediates which have an unpaired electron. Tertiary alkyl free radicals are more stable than secondary alkyl free radicals and secondary alkyl free radicals are more stable than primary alkyl free radicals. Thus, t-butyl radical (a tertiary radical) is energetically more favoured than the ethyl radical. An example of a free radical reaction pathway is as follows:

1. Initiation:

$$M \xrightarrow{k1} 2R.(\text{Smaller alkyl radical}) \quad (1)$$

(M = Mother molecule)

2. Propagation:

$$R + M \xrightarrow{k2} RH + M.(\text{chain reaction}) \quad (2)$$

$$M. \xrightarrow{k3} R + \text{Olefins } (\beta\text{-Scission reaction})$$

3. Termination $$R. + R \xrightarrow{k4} \text{Products}$$

Free radical reactions are influenced by the reactor pressure and, in particular, hydrogen pressure. Consequently, hydrogen pressure is important for hydroprocessing systems. At elevated pressures, i.e., greater than 7 MPa, the reactions followed under low pressure do not generally proceed. Under elevated pressure of hydrogen, hydrogen addition reactions become more favourable. Further, β-scission reactions are less significant under elevated pressure. Therefore, at elevated pressures, rather than multistage cracking via olefin formation, free radicals are stabilized in a single step without formation of olefins. In the intermediate pressure range of 3-7 MPa, a complicated two step mechanism is possible. At lower pressures, cracking reactions form olefins that can be used as fluid catalytic cracking feedstocks.

Thiols, aliphatic sulfides (thioethers), and disulfides are very reactive under thermal conditions and can range as high as 50% of total sulfur in many heavy crude oils bitumens and asphalts. Thermal reactions of these types of sulfur are favorable because carbon-sulfur bonds are weaker than other carbon-carbon bonds. For example, $$R—S—R' + 2H_2 \Longrightarrow H_2S + RH + R'H$$

When thermal cracking occurs in the presence of hydrogen and a catalyst, the reaction pathways change significantly. While thermal cracking still occurs, hydrogenation and hydrogenolysis also occur in parallel, thereby changing the chemical nature of the molecules being cracked. Sulfur and nitrogen are removed from heterocycles producing $H_2S$ and $NH_3$ and the formation of carbon-hydrogen bonds. The resultant aliphatic chains can then be cracked to produce light hydrocarbons such as methane, ethane, etc.

Hydrogen can also cap radicals and terminate polymerization reactions, thereby reducing or eliminating coke formation. Therefore, it has been discovered that the partial pressure and purity of hydrogen is significant. As discussed herein, maintenance of high hydrogen pressure in the hydroprocessing unit is needed. However, what is also important is the partial pressure of hydrogen. Accordingly, it is desirable to lower the impurity concentration (light hydrocarbon gases) to maintain a high hydrogen pressure in the hydrotreating unit.

The catalysts normally employed in hydrotreating are metal sulfide based and greatly accelerate hydrodesulfurization reactions leading to low sulfur products. While it is believed that the catalyst do not directly catalyze cracking to any great extent, and it is known that catalysts are easily poisoned by metals normally present in heavy crude oils, the catalysts can still be designed to accelerate cracking reaction. Moreover, even though metal sulfides catalyze hydrogenation of aromatics, because this reaction is reversible and very exothermic, temperatures normally employed to achieve high conversion of material are high, e.g., approximately 450° C. or more, and, thus, tend to favor the reverse reaction (dehydrogenation of aromatics).

Unless operated at high $H_2$ pressure and low LHSV (in order to reduce the temperature and still enable high conversions), most upgrading processes can only achieve low to moderate levels of aromatic saturation. This leads to yields of $C_1$ to $C_5$ hydrocarbon gases which can reach 10 wt % of feed. One of the benefits of this invention is realizing value from these hydrocarbon gases. Because each mole of gas consumes approximately one mole of hydrogen, overall hydrogen consumption can reach 3 wt % of feed (approximately 2000 scf/bbl) in a relatively high pressure process.

All of the foregoing methods involve contacting heavy crude oils with hydrogen at pressure above approximately 1000 psi and temperatures up to 470° C. The heavy crude oil feedstock is thermally cracked and hydrogenated to yield products with increased hydrogen to carbon ratio, reduced sulfur and nitrogen content, and boiling points suitable for refining to various liquid fuels. Generally, the processes can be divided into those employing high activity HDS catalysts based on metals such as Co, Mo, and Ni, which produce low sulfur products, and those using less catalytically active additives or very low concentrations of a more active catalyst designed for coke inhibition and demetallization, which produce higher sulfur products requiring more extensive hydrotreatment. Catalytic promoters such as phosphorus, silica, alkali, and alkali earth metals are also useful.

The prior methods also encounter transport limitations in the upgrading process. Generally, there are two common forms of three-phase (gas, liquid and solid catalysts) reactors are the slurry and trickle-bed (counter flow of liquid and gases over a bed-of catalyst). It is often assumed that the systems are well mixed. In reality, the systems are not well mixed. In fact, formation of gas bubble of hydrogen can impede mass transfer of hydrogen to the catalyst surface. To address this problem, the overall reaction consists of the following sequence of events: mass transport from the bulk concentration in the gas bubble to the bubble-liquid interphase; mass transport from the bubble interface to the bulk liquid phase; mixing and diffusion of in the bulk liquid; mass transfer to the external surface to the catalyst particles; and reaction at the catalyst surface. Although one would expect that introduction of mixing would allow uniform conditions in the bulk liquid, such gas-liquid mixing is often limited. Therefore, the present invention addresses this shortcoming by providing improved mass transport in the upgrading process.

Further, processes for the thermal and catalytic rearrangement of heavy hydrocarbon crude oils and other similar feedstocks is described by de Bruijn et al. in U.S. Pat. Nos. 5,104,516 and 5,322,617, the contents of which are hereby incorporated by reference. In the disclosed processes, a heavy hydrocarbon crude oil or heavy hydrocarbon crude oil feedstock dispersion is reacted with synthesis gas in the presence of a catalyst to reduce the viscosity and density of heavy hydrocarbon crude oil, thus making it more amenable for transportation by a pipeline. The processes disclosed in Bruijn et al. provide for the recovery of hydrogen and carbon dioxide gases as by-products, and the recycling of carbon monoxide back into the rearrangement process. Use of a bifunctional catalyst present in about 0.03 to about 15% under conditions and pressures that facilitate both the gas shift reaction and the rearrangement of hydrocarbons are described. The bifunctional catalyst includes an inorganic base and a catalyst containing a transition metal such as iron, chromium, molybdenum, or cobalt.

The gas shift reaction is an industrial process in which carbon monoxide (CO) and ($H_2O$), in the form of steam, are reacted in the presence of a catalyst to give carbon dioxide ($CO_2$) and hydrogen ($H_2$) as shown in the following equation:

$$CO\,(g) + H_2O\,(g) \Longrightarrow CO_2\,(g) + H_2\,(g)$$

In the process disclosed by de Bruijn et al. the gas shift reaction is used to generate the hydrogen used to rearrange the hydrocarbons within the feedstock, and also to produce excess gas which is recovered as by-products. As disclosed in Bruijn et al., the source of CO can be carbon monoxide mixed with synthesis gas or generated in-situ from the decomposition of methanol.

Synthesis gas (syngas) is a mixture of hydrogen ($H_2$) and carbon monoxide (CO) typically in a range of ratios between about 0.9 to about 3.0. It is commonly made by the controlled combustion of methane, coal, or naphtha with oxygen to give a mixture of gases including hydrogen ($H_2$), carbon monoxide (CO), carbon dioxide ($CO_2$), hydrogen sulfide ($H_2S$), carbonyl sulfide (COS), and others. It is conventional to "clean-up" the produced combustion gases to give pure synthesis gas. A critical prerequisite for the use of syngas in reactions catalyzed by transition metals is the removal of sulfur containing compounds, such as $H_2S$ or COS, formed from sulfur compounds in natural hydrocarbons or coal.

The processes disclosed by de Bruijn et al., also known as CANMET technology, suffer from significant deficiencies when practiced on an industrial scale. Specifically, the CANMET technology: lacks a suitable source for synthesis gas within the process scheme; generates waste products such as coke, heavy hydrocarbon crude oil residues, and spent catalyst that must be disposed of in an environmentally conscious manner; generates by-products highly contaminated with hydrocarbons that require significant treatment before being released to the environment; requires an economic source of heat for the upgrading/rearrangement reactions; prefers a separate sulfiding step to activate the catalysts utilized in the upgrading/rearrangement reactions; is limited by the slow kinetics of the gas shift reaction; and, has problems with the stability and breakdown of the heavy hydrocarbon crude oil and heavy hydrocarbon crude oil feedstock dispersion.

Subsequent disclosures by Khan et al in U.S. Pat. No. 5,935,419 entitled "Methods for Adding Value to Heavy Oil Utilizing a Soluble Metal Catalyst," and U.S. Pat. No. 6,059,957 entitled "Methods for Adding Value to Heavy Oil" provide a solution to the above problems. However, these two patents involved the use of water in the feedstock along with heavy crude oil specifically to integrate the upgrading process with a gasification process. Use of water in the crude oil, while beneficial in certain gasification conditions, can create serious operating difficulties in an upgrading unit. Such difficulties include the fact that water is a scare resource in many parts of the world, particularly in Middle-East. Second, the use of water in a pressurized upgrading unit can cause serious operational challenges as water vaporizes and expands into reaction.

Therefore, one advantage of the present invention is the ability to define a better way to utilize hydrogen while processing heavy crude oil under lower operating pressure. Furthermore, the hydrogen containing gas preferably used in the upgrading process has a high purity (>90% $H_2$), thereby improving the overall reaction chemistry. Previous upgrading processes did not address the importance of the quality of the hydrogen purity in the upgrading process, while maintaining a relative low operating pressure. This invention also teaches the benefit of oil soluble catalysts (also known as nano catalysts). Unlike heterogeneous catalysts, oil soluble homogeneous catalysts disperse well and do not precipitate during crude oil processing.

This invention is also directed to improving mass transport by premixing the gas and liquid with a dispersed catalyst prior to reactions in a well-mixed reactor system where upgrading of crude oil takes place. The upgraded product is subsequently separated and further treated to improve quality. Various fractions can then be separated and used in the most economical way. The $H_2S$ and $CO_2$ generated during upgrading of the crude oil can also be injected into a reservoir for re-use.

The residue generated in an upgrading process is generally of low value. In addition, the evolved light gases, e.g. methane, ethane, and propane do not have high-value. One of the objectives of this invention is to use the residue along with the light gases to make these materials into value added products such as aromatics and olefins in a fluid catalytic cracking ("FCC") unit. The FCC unit is a carbon rejection and hydrogen transfer device. The FCC process tailors the carbon distribution based on the hydrocarbon structures in the feedstock and the drive towards equilibrium in the cracking process. Historically, the FCC unit has been viewed as a relatively inexpensive gasoline and light olefin generator that now has significant application as a residual oil upgrader. The FCC unit and its constituent parts are well known in the art. Examples of FCC unit can be found in U.S. Pat. No. 2,737,479. Some FCC units can accommodate refinery residue and/or heavy oil.

Hydrocarbon catalytic cracking processes increasingly employ a system whereby the hydrocarbon feedstock is cracked in the presence of a high activity cracking catalyst in a riser-type reactor. In general, the FCC process proceeds by contacting hot regenerated catalyst with a hydrocarbon feed in a reaction zone under conditions suitable for cracking; separating the cracked hydrocarbon gases from the spent catalyst using a gross cut separator followed by conventional cyclones; steam stripping the spent catalyst to remove hydrocarbons; subsequently feeding the stripped, spent catalyst to a regeneration chamber where a controlled volume of air is introduced to burn the carbonaceous deposits from the catalyst; and returning the regenerated catalyst to the reaction zone.

Most FCC units are operated to maximize conversion to gasoline. This is particularly true when building gasoline inventory for peak season demand. Maximum conversion of a specific feedstock is usually limited by both FCC unit design constraints (i.e., regenerator temperature, wet gas capacity, etc.) and the processing objectives. However, within these limitations, the FCC unit operator has many operating and catalyst property variables to select from to achieve maximum conversion. The primary variables available to the FCC unit operator for maximum unit conversion for a given feedstock quality can be divided into two groups, catalytic variable (catalyst activity, design) and process (temperature, pressure, reaction time, extent of catalyst regeneration etc.). These variables are not always available for maximizing conversion because most FCC units are already operating at an optimum conversion level corresponding to a given feed rate, set of processing conditions, and catalyst at one or more unit constraints (e.g., wet gas compressor capacity, fractionation capacity, air blower capacity, reactor temperature, regenerator temperature, catalyst circulation). Therefore, the operator has only a few operating variables to adjust. Once the optimum conversion level is found, the operator has no additional degree of freedom for changing the operating variables. However, the operator can work with the catalyst supplier to redesign the catalyst properties to remove operating constraints to shift the operation to a higher optimum conversion level or alternatively utilize low cost feedstock that would maximizes light olefins per unit of cost of feedstock in a suitable FCC unit.

It is known in the art that for the crystalline silicates, long chain olefins tend to crack at a much higher rate than the corresponding long chain paraffins. When crystalline silicates are employed as catalysts for the conversion of paraffins into olefins, the conversion rate decreases as the time on stream increases, which is due to formation of coke (carbon) which is deposited on the catalyst. Many advanced commercially available catalysts can be used for converting a variety of feedstock in a typical FCC. The primary cracking catalysts are made of zeolite and matrix (clay and a binder). For increased production of $C_2$ and $C_3$ olefins, the ZSM-5 additives are also used. Typical FCC sulfur reducing additives are also applied, such as RESOLVE® (trade name) from AKZO Nobel is an example.

Known FCC processes are employed to crack heavy paraffinic molecules into lighter molecules. However, when it is desired to produce propylene, not only are the yields low, but the stability of the crystalline silicate catalyst is also low. For example, in an FCC unit a typical propylene output is 3.5 wt %. The propylene output may be increased to up to about 7-8 wt % propylene from the FCC unit by introducing the ZSM-5 catalyst into the FCC unit to "squeeze" out more propylene from the incoming hydrocarbon feedstock being cracked. Not only is this increase in yield quite small, but also the ZSM-5 catalyst has low stability in the FCC unit.

The petrochemical industry is presently facing a major squeeze in propylene availability as a result of the growth in propylene derivatives. Traditional methods to increase propylene production are not entirely satisfactory. For example, additional naphtha steam cracking units which produce about twice as much ethylene as propylene are an expensive way to yield propylene since the feedstock is valuable and the capital investment is very high. Typically, naphtha is in competition as a feedstock for steam crackers because it is a base for the production of gasoline at refineries. Propane dehydrogenation gives a high yield of propylene but the feedstock (propane) is only cost effective during limited periods of the year, making the process expensive and limiting the production of propylene. Propylene is obtained from FCC units, but at a relatively low yield. Increasing the yield has proven to be expensive and limited.

Thus there is a need for a high yield propylene production method which can readily be integrated into a refinery or petrochemical plant, taking advantage of feedstocks that are less valuable for the market place (having few alternatives on the market). The heavy residue fraction and the light off gases from an upgrading unit which contain significant amount of $C_2$-$C_8$ products including aromatics, olefins and naphtha are excellent feedstock for a FCC unit to produce higher value products.

SUMMARY OF THE INVENTION

In one embodiment of the inventive process, a heavy hydrocarbon crude oil or heavy hydrocarbon crude oil feedstock dispersion is created and reacted with high purity hydrogen in the presence of a transition metal catalyst to give a product stream having both lighter oil and a heavy hydrocarbon crude oil residue.

The present invention is directed to an improved process for upgrading heavy hydrocarbon crude oil into lighter, low sulfur, and lower density oil. One embodiment of the inventive process involves contacting a heavy hydrocarbon crude oil with a catalyst which is then reacted with high purity hydrogen gas at a relatively low pressure to make a product stream having a lighter oil and a heavy hydrocarbon crude oil residue; and separating from the product stream the lighter oil to which further treatment in a second upgrader occurs. A preferred low pressure range is 500-1500 psi. The further treatment can occur in a conventional hydrotreator with a catalyst to remove additional residual tightly bound sulfur. The light gases and heavy fractions can be sent to a conventional fluid catalytic cracking unit to convert the materials into value added products such as olefins and aromatics. The heavy hydrocarbon crude oil residue can also be further treated by fractioning into portions wherein a portion is sent to prepare a feedstock for making carbon-based products such as carbon fiber, asphalt for road applications, or combustion materials in power generation (optionally after making a water-slurry). Additionally, a portion can be recycled to the heavy hydrocarbon crude oil feedstock stream at the beginning of the process. The heavy hydrocarbon crude oil residue can also be processed in a high shear environment so as to reduce viscosity. Additionally, the product stream containing the light oil can be heat soaked.

In another aspect, the invention is directed to formation of a product stream that is separated into a lighter oil stream and a heavy hydrocarbon crude oil residue stream. Part of the heavy hydrocarbon crude oil residue stream can be mixed with the feedstock heavy hydrocarbon crude oil for further reaction with high purity hydrogen in the presence of a transition metal catalyst while the remainder the heavy hydrocarbon crude oil residue can be used for making asphalt for construction of roads or for combustion in power generation.

In another embodiment, the invention is directed to a sulfur containing crude oil desulphurization process. The process comprises the steps of hydrodesulfurizing a sulfur containing crude oil feed using an oil soluble catalyst in a crude desulphurization unit to obtain a desulfurized crude oil; separating the desulfurized crude oil into a light gas fraction, a light oil fraction, a heavy oil fraction, and a residual fraction; passing a portion of the light oil fraction and a portion of the heavy oil fraction in combination with hydrogen to a secondary upgrading unit reaction zone; hydrocracking the portion of the light oil fraction and the portion of the heavy oil fraction in the secondary upgrading unit reaction zone to produce an effluent; passing a portion of the residual fraction and a portion of the light gas fraction through a fluid catalytic cracking unit; and cracking the portion of the residual fraction and the portion of the light gas fraction in the fluid catalytic cracking unit to produce at least one light olefin and at least one aromatic product.

In yet another aspect, the invention is directed to a process for providing a reduced sulfur fuel and chemical feedstock product. The process comprises the steps of hydrodesulfurizing a crude oil feed using an oil soluble catalyst in a crude desulphurization unit to obtain a desulfurized hydrotreated crude oil; fractionating the hydrotreated crude oil into at least one product gas, a light oil fraction, and a heavy oil fraction; cracking the heavy oil fraction along with each of the at least one light gases in a riser reactor of a fluid catalytic cracking unit in the presence of a cracking catalyst and a sulfur removal catalyst to produce at least one cracked product and a spent catalyst; separating the at least one cracked product from the spent catalyst in a separator; and fractionating the at least one cracked product to produce a hydrogen-containing gas stream and a reduced sulfur gasoline stream, an olefinic feedstock stream, and a heavier than gasoline stream. A further feature of this process comprises the steps of obtaining heavy naphtha from said fractionation in step (e) and recycling said heavy naphtha to said riser reactor; and obtaining hydrogen containing gas from the fractionation and combining the hydrogen containing gas with the desulfurized hydrotreated crude oil.

The invention is also directed to a method of enhancing the stability of a dispersion of heavy hydrocarbon crude oil and to the composition of the resulting stabilized heavy hydrocarbon oil/dispersion fuel.

BRIEF DESCRIPTION OF THE DRAWINGS

These and other features of the present invention are more fully set forth in the following description of illustrative embodiments of the invention. The description is presented with reference to the accompanying drawing in which.

Figure 1:
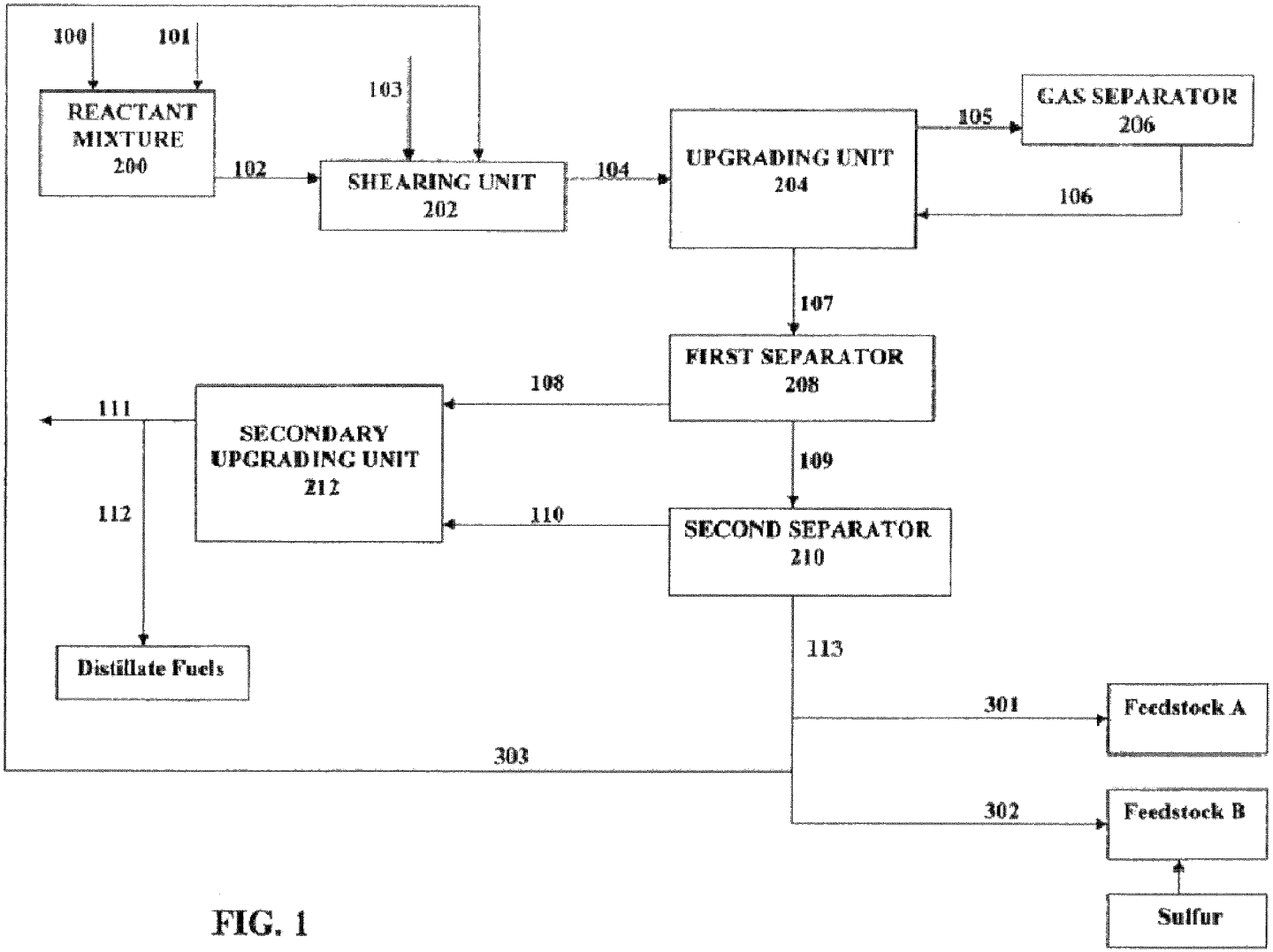
FIG. 1 is a schematic process flow diagram of an illustrative embodiment of the present invention.

While the invention will be described in connection with the preferred embodiment, it will be understood that it is not intended to limit the invention to that embodiment. On the contrary, it is intended to cover all alternatives, modifications, and equivalents, as can be included within the spirit and scope of the invention as defined in the appended claims.

DETAILED DESCRIPTION OF THE INVENTION

A process flow diagram of embodiments of the present invention is shown in FIG. 1. In this flow diagram, it should be understood that components, such as upgrading unit 204 and shearing unit 202, have been represented as boxes for the sake of simplicity of illustration. As is well recognized by persons skilled in the art, both of these units contain numerous components, such as reactors in upgrading unit 204 and heating elements and mixing elements in shearing unit 202. In general, shearing unit 202 can also be referred to as an emulsifier mixer, dispersion mixer, sonic unit or preheater. One of ordinary skill in the art should understand and appreciate that implementation of the actual process will be more detailed and will also depend upon, among other things, the scale, cost, quality and quantity of feedstock and the reactor pad space available.

As shown in FIG. 1, heavy hydrocarbon crude oil from stream 100 ("heavy crude") is combined with catalyst from stream 101 to form reactant mixture 200. Reactant mixture 200 is transferred along stream 102 into shearing unit 202 where reactant mixture 200 is preheated and mixed using a rotor stator system to form a heavy hydrocarbon oil dispersion. In one embodiment, shearing unit 202 is a 450X-series machine manufactured by Ross to provide the shearing force. Unlike traditional homogenizers, the 450X-Series rotor and stator is composed of a matrix of interlocking channels. With the rotor turning at high speeds (i.e., tip speeds as high as 17,000 rpm) the 450X-Series machine can produce dispersions comparable to those produced by a high pressure homogenizer. However, it is to be understood that various other units commercially available can be suitable for the purpose. For example, shearing in shearing unit 202 can also be achieved by the use of low cost ultrasonic devices such as those available from Hielscher USA, Inc., 19 Forest Road, Ringwood, N.J. 07456 USA; Active Ultrasonics, Puits-Godet 6A, CH-2000 Neuchatel, Switzerland; and Silverson Machine, Inc., 355 Chestnut St., PO Box 589, East Longmeadow, Mass. 01028.

In one embodiment, shearing unit 202 utilized in this invention is a precision engineered rotor/stator workhead, which far outperforms conventional mixers, and cuts processing times by up to 90%, improving quality, product consistency, and process efficiency. Such a high shear mixer is available from Silverson Machine, Inc.

The mixing of the crude oil and the catalyst in shearing unit 202 forms a heavy hydrocarbon crude oil dispersion that can them be transferred along stream 104 to upgrading unit 204. Alternatively, reactant mixture 200 is mixed to form a heavy hydrocarbon crude oil dispersion prior to entry into shearing unit 202.

Typically, reactant mixture 200 is preheated in shearing unit 202 to a temperature in the range of between about 300° C. and 350° C.; although, the preheating step can occur prior to introduction of the reactant mixture into shearing unit 202. During this step it is believed that the catalyst interacts with sulfur moieties of the heavy hydrocarbon crude oil and the catalyst is sulfated in-situ. The terms "to sulfate" and "sulfated" as used herein means the chemical act of combining an element or compound with sulfur or one or more sulfur containing compounds. Shearing of the crude oil in these conditions leads to dissociation of some weakly bound forces and, thus, at least partial upgrading of the heavy hydrocarbon crude oil occurs in shearing unit 202. Further, it is believed that during this step the heavy hydrocarbon crude oil is conditioned by temperature so that the heavy hydrocarbon crude oil becomes suitable for use in the reactor of upgrading unit 204 without coking or retrogressive reactions.

Typically, the concentration of catalyst introduced into reactant mixture 200 falls in the range of between about 50 ppm and about 0.1% of the crude oil. It has been found that when a combination of catalysts is used, the total amount of catalyst added is typically less than the amount used for any single catalyst. Thus, when a combination of catalysts are used to achieve a stabilized dispersion, the total catalyst concentration typically falls in the range of between about 100 ppm and about 0.1% of the heavy crude oil feedstock. Oil soluble catalysts are preferred over oil insoluble catalysts that tend to settle and plug reactors.

In one specific embodiment, a hydrogen containing gas can also be combined with reactant mixture 200. As illustrated in FIG. 1, the hydrogen containing gas is introduced into shearing unit 202 along stream 103 and, thus, combined with the reactant mixture 200 in shearing unit 202. However, it is to be understood that the hydrogen containing gas can be combined with the reactant mixture, or either component of reactant mixture 200, prior to introduction of reactant mixture 200 into shearing unit 202. Alternatively, the hydrogen containing gas can be combined with reactant mixture 200 in upgrading unit 204.

After formation of the heavy hydrocarbon oil dispersion, with or without combination with the hydrogen containing gas, the heavy hydrocarbon oil dispersion is introduced into upgrading unit 204 via stream 104 at an appropriate point depending upon unit design. Hydrogen containing gas can also be introduced into upgrading unit 204 at an appropriate point from gas separator 206 along stream 106. Regardless of source, hydrogen containing gas is preferably preheated using suitable heating means known to one skilled in the art prior to introduction into upgrading unit 204, shearing unit 202, or either component of reactant mixture 200.

The hydrogen containing gas utilized in the present invention can be generated in another part of the refinery such as a FCC effluent or it can be purchased "off the shelf" from a vendor. Therefore, while FIG. 1 shows the hydrogen containing gas originating from both stream 103 and gas separator 206, it is to be understood that the hydrogen containing gas can be introduced into shearing unit 202 or upgrading unit 204 from any source known to persons skilled in the art.

One alternative to purchasing hydrogen containing gas from a vendor is shown in FIG. 1. In this alternative, the hydrogen containing gas is obtained from the reactors in upgrading unit 204 by purification of the reactor off-gases under pressure as described in pending U.S. patent application Ser. No. 10/788,947, filed Sep. 1, 2005, which is incorporated herein in its entity. In one specific preferred embodiment, the hydrogen containing gas contains 90% or more hydrogen and, thus, is referred to as "high purity hydrogen." Hydrotreating includes terms such as hydrocracking as well as hydrogeneration.

Within upgrading unit 204, the crude oil of reactant mixture 200 is converted into the desired light oil end product. Upgrading unit 204 can include either a single or multiple reactor units either in parallel or in series. In one preferred embodiment, upgrading unit 204 comprises two trains of two reactors in series.

In one specific embodiment, a supplementary charge of the heavy hydrocarbon crude oil dispersion is introduced into the reactor of upgrading unit 204 along stream 104 at a point between the series of reactors so that the two reactors operate at approximately the same temperature. The reactors generally are operated in the temperature range of between about 400° C. and about 500° C., a pressure range of between about 500 psi and about 2200 psi (preferably between 500 psi and most preferably between 1000-1200 psi), and at a flow rate in the range of between about 5 gal/day and about 100,000 BBL/day. In one preferred embodiment, the reactor is designed for up-flow operation with each reactor having its own inlet distributor system. Other reactor designs can be suitable and, thus, used within the scope of the present invention.

Although not intending to be limited by any particular theory, it is believed that the primary reaction is occurring within the reactors of upgrading unit 204 in which hydrocracking of the hydrocarbons constituting the heavy hydrocarbon crude oil generates a majority of the product light oil.

In another embodiment, catalyst, or additional catalyst, can be introduced directly into the reactors (not shown in FIG. 1) of upgrading unit 204 in a number of ways, including but not limited to, as a mixture with the heavy hydrocarbon crude oil feedstock, by co-injection with the heavy hydrocarbon crude oil feedstock dispersion, or by direct injection into the reactor of upgrading unit 204.

The catalyst in catalyst stream 101 preferably contains a transition metal, transition metal-containing compound, or mixtures thereof in which the transition metal is selected from the Group V, VI and VIII elements in the Periodic Table of Elements. More preferably, the transition metal is selected from the group in which the metal is vanadium, molybdenum, iron, cobalt, nickel or combinations thereof. Both dispersion and oil soluble transition metal compounds can be used in the catalyst, including metal naphthanates, metal sulfates, ammonium salts of polymetal anions, MOLYVAN™ 855 which is a proprietary material of organomolybdenum complex of organic amide (CAS Reg. No. 64742-52-5) containing 7 to 15% molybdenum commercially available from R. T. Vanderbilt Company, Inc. of Norwalk, Conn., molybdenum HEX-CEM which is proprietary mixture containing 15% molybdenum 2-ethylhexanote available from Mooney Chemicals, Inc. of Cleveland Ohio, and other similar compounds. MOLYVAN™ 855 contains four component systems and can serve as an excellent upgrading catalyst. However, it is understood that other suitable catalysts that are highly soluble in oil while having a relatively high loading of Mo can also be suitable catalysts.

In addition, a transition metal-containing waste stream, for example, from a polyolefin/methyl t-butyl ether process containing between 2 and 10% molybdenum in an organic medium which principally is composed of molybdenum glycol ethers, is also a suitable source of catalyst. Additionally, the addition of certain inorganic particles, including nickel and vanadium, into catalyst stream 105 was found to increase the yield, and decrease the density, of the final light oil product.

The starting material heavy hydrocarbon crude oil typically has a sulfur content of about 3%. Upon reaction of a portion of the heavy hydrocarbon crude oil dispersion in the upgrading unit 204 of the present invention, with a molybdenum based catalyst, such as the MOLYVAN™ family of catalysts, and a mixture containing vanadium and nickel compounds, the sulfur content is decreased to a value in the range of between about 1.2% to about 1.5%. Therefore, the processes of the present invention are capable of removing sulfur from the heavy crude oil.

In one embodiment of the present invention, gas by-product is removed from upgrading unit 204 along stream 105 and introduced into gas separator 206. Useful gases derived from the separation process, including hydrogen and gaseous hydrocarbons, can be recycled to upgrading unit 204 from gas separator 206 by transferring these elements and compounds along stream 106 to upgrading unit 204. Alternatively, hydrocarbon gases can be sent to an FCC unit.

In a preferred embodiment, hydrogen sulfide gas ("off-gas") is separated from the gas by-product in gas separator 206 and recycled back into upgrading unit 204 along stream 106 to sulfate the catalyst in upgrading unit 204. Alternatively, the hydrogen sulfide gas can be recycled back to shearing unit 202 or to any other location along the pathway of the process to sulfate the catalyst. In one such embodiment, at least a portion of the hydrogen sulfide gas generated during the reaction product separation process in gas separator 206 is reintroduced into upgrading unit 204. Preferably, this hydrogen sulfide gas is mixed with the heavy hydrocarbon crude oil feedstock dispersion prior to injection into the reactor of upgrading unit 204, i.e., in shearing unit 202 or along stream 104 before entry into upgrading unit 204. The sulfated catalyst is believed to increase the yield of the desired light oil products boiling below 1000° F. Furthermore, this mode of presulfiding reduces operating expense and has been found to improve the overall upgrading reaction chemistry. Experiments conducted in the absence and the presence of $H_2S$ or $CS_2$ in the reaction have shown that the presence of the sulfur compounds improves the quality of the light oil product, such as increased distillate yield and asphaltene content.

One skilled in the art will appreciate the cost and performance benefits of in-situ activation and sulfurating of the transition metal catalyst. Under the current state of the art, these steps are conducted as separate steps within the reactor or in a separate portion of the refinery facility. By conducting the activation/sulfurating step in-situ in accordance with the present invention, the reactor down-time needed to conduct the sulfiding steps in the upgrading reactor itself and the capital costs of separate facilities are eliminated. Additional cost savings can be realized by the elimination of the gas scrubbing steps conventionally conducted in the production of synthesis gas.

Upgrading unit product stream 107 leaving upgrading unit 204 is a mixture including heavy hydrocarbon crude oil residues and light oil. When olefins are the most desired products, stream 107 can be separated into a light oil fraction and a heavy oil fraction. Conventional separation technology can be used to separate the components of upgrading unit product stream 107. As illustrated in FIG. 1, first separator 208 is used to separate upgrading unit product stream 107 into light oil stream 108 and heavy oil residue stream 109. Preferably, second separator 210 further separates light oil from heavy oil residue stream 109. This second light oil stream 110 can then be combined with first light oil stream 108 in secondary upgrading unit 212 for further processing. Alternatively, one or both of light oil streams, 108, 110 can be end-products.

In a preferred embodiment of the present invention, the heavy hydrocarbon crude oil residue in heavy crude oil residue stream 109 is first separated from upgrading unit product stream 107 in first separator 208 which is a hot separator. Light oil is also separated in first separator 208 and transported along light oil stream 108; however, the majority of the light oil is separated from heavy crude oil residue stream 107 in second separator 210 which is a cold separator. The light oil is then removed from second separator 210 along light oil stream 110.

In the event that light oil streams 108, 110 are end products, the light oil can be stabilized by bubbling nitrogen or some other inert gas through it so as to remove any dissolved gases. Light oil as end products can be utilized elsewhere in the refinery facility, stored on-site for use at a later date, or shipped to another refinery site, or could be used as a preferred solvent to separate hydrogen from off-gasses in gas separator 206.

Additionally, light oil streams 108, 110 can be further processed in one or two secondary upgrading units 212 to form ultra clean fuels that is removed from secondary upgrading unit 212 along stream 111. The secondary upgrading can be achieved in one or two-step processes. Distillate fuels can also be formed from secondary upgrading unit 212 or stream 111 and, thus, separated from ultra clean fuels along stream 112.

In another specific embodiment, the stability of the distillate fuels can be increased by homogenization of heavy hydrocarbon crude oil residue streams 109, 113. By processing heavy hydrocarbon crude oil residue 109, 113 in such a manner, agglomerations of asphaltenes and other sediments are reduced in size which increases stability of the distillate fuels.

In one embodiment of the present invention, a portion of the oil residue streams 109, 111 can be used as feedstock for fluid catalytic cracking (FCC) unit.

In another embodiment, the heavy hydrocarbon crude oil residue streams 109, 113 and the light gases from upgrader 204 and 212 are passed into an FCC unit to maximize olefin conversion. During crude desulfurization and upgrading, a significant amount of light gases, such as methane, ethane, and propane are evolved. One of the objectives of this invention is to maximize the benefit of the evolved lighter gases which is of low value compared to chemical feedstock such as olefins. The cracked products from the FCC unit can be separated for receiving said cracked product and spent catalyst. The cracked product will contain at least a reduced sulfur gasoline stream, an olefinic feedstock, and a heavier than gasoline stream. The heavy naphtha from the fractionation is recycled to the riser reactor.

The heavy hydrocarbon crude oil residue stream 113 from second separator 210, or, if no second separator 210 is utilized, heavy hydrocarbon crude oil residue stream 109 can be utilized in value added products such as feedstock A, along stream 301, for use in forming carbon fiber material. It has been discovered that heavy hydrocarbon crude oil residue streams 109, 113 have a boiling point the range of 400° C.-520° C. which are suitable feedstock for making carbon fiber material. Therefore, in another aspect of the present invention, carbon fiber feedstock can also be formed from heavy crude oil.

Heavy hydrocarbon crude oil residue streams 109, 113 can also be utilized in value added products such as feedstock B, along stream 302, for use in making asphalt for road applications or as asphalt-water slurry combustion materials in power generation.

It is well-known that the quality of the asphalt can be improved by addition of external sulfur. Therefore, in one embodiment, the asphalt quality of the separated material is improved with the addition of elemental sulfur as indicated in FIG. 1 with respect to feedstock B as part of the process for making for asphalt for road applications or as asphalt-water slurry combustion materials in power generation.

Alternatively, heavy hydrocarbon crude oil residue streams 109, 113 can be recycled along stream 303 back to shearing unit 202 for further refining.

In one embodiment of the present invention, at least a portion of the light gases, e.g. methane, is utilized as fuel for a combustion unit that in turn heats upgrading unit 204 or shearing unit 202. In this embodiment, a conventional combustion unit is utilized. As an option, the combustion is conducted after a small quantity of CaO is introduced with the asphalt, in which case the sulfur emission is significantly reduced during combustion.

In yet another embodiment of the present invention, a portion of reactant mixture 200 can have a boiling point below 1000° F. This portion can be subjected to hydrotreating while it is still hot in a process referred to as secondary hydrotreating or integrated hydrotreating. The secondary hydrotreating of this portion of reactant mixture 200 can be carried out using hydrotreating conditions known to persons skilled in the art. Generally, secondary hydrotreating involves reacting this portion of reactant mixture 200 with a hydrogen containing gas in the presence of a supported metal oxide catalyst under elevated temperatures and pressures. Catalysts which can be utilized in the integrated hydrotreating process of this embodiment can be selected from a number of commercial catalysts including Criterion TEX-2710 catalyst, a commercially available molybdenum oxide/nickel oxide catalyst supported on alumina and promoted with silica; Criterion HDS-2443 catalyst, a commercially available molybdenum oxide/nickel oxide catalyst supported on alumina and promoted with silica and phosphorous oxide; and Criterion 424 catalyst, a commercially available molybdenum oxide/nickel oxide catalyst supported on alumina and promoted with phosphorous oxide and other similar such catalysts. All of the proceeding catalysts are available from Criterion Catalysts of Houston, Tex. Another alternative is the use of Akzo Nobel catalyst called Nebula which provides high activity.

The following example is included to demonstrate various embodiments of the invention. It should be appreciated by those of skill in the art that the techniques disclosed in the examples which follow represent techniques discovered by the inventors to function well in the practice of the invention and, thus, can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

EXAMPLE

In the following Example, the heavy hydrocarbon crude oil feedstock is a heavy crude oil having the characteristics shown in Table 1 below:

TABLE 1

| Total Oil Composition: Feed Oil | |
|---|---|
| % Total Distillates (BP < 524° C.) | 60% |
| % Asphaltenes | 10% |
| S (% wt) | 3.5 |

This heavy crude oil was pretreated with an ultrasonic and shearing system in the presence of hydrogen gas to disperse the system. To this mixture a sufficient amount of commercially available MOLYVAN™ 855 was added to give a concentration of 100 ppm within the heavy crude oil dispersion. After suitable conditioning of the heavy crude oil dispersion was completed, the dispersion was reacted in a well-mixed reactor of upgrading unit 204 with hydrogen gas at a temperature of about 430° C. and a pressure of about 1500 psig; LHSV 1.0.

The resulting light oil product was then separated from the reaction product to give oil having the properties in Table 2.

TABLE 2

| Liquid Product |
|---|
| % Total Distillates > 90 (BP < 524° C.) |
| % Desulfuization > 90 |
| S = 0.2 wt % |
| % Asphaltenes < 1% |

The light oil product of this Example was obtained after hydrotreating the upgraded product in secondary upgrading unit 212.

The API gravity of the light oil product of this Example was significantly increased indicating a lighter oil product. In addition, a beneficial decrease in the asphaltene concentration and the concentration of both sulfur and metals was observed.

As discussed above, one by-product of the removal of sulfur from the heavy crude oil is $H_2S$ gas. Therefore, in an alternative embodiment, the $H_2S$ gas generated in the process is reinjected in the depleted reservoirs to minimize overall sulfur removal or expenses for the sulfur plant.

While the compositions and methods of this invention have been described in terms of preferred embodiments, it will be apparent to those of skill in the art that variations can be applied to the process described herein without departing from the concept, spirit, and scope of the invention. All such similar substitutes and modifications apparent to those skilled in the art are deemed to be within the spirit, scope and concept of the invention as it is set out in the claims. For example, the crude oil and catalyst can be combined in the shearing unit to form the reactant mixture. Additionally, hydrogen containing gas can be combined with the reactant mixture after the reactant mixture enters the upgrading unit. Further, the hydrogen containing gas can be introduced into the processes of the present invention along one or both of stream 103 or stream 106.

What is claimed is:

1. A process for refining heavy hydrocarbon crude oil having sulfur, comprising the steps of:

(a) combining a portion of the heavy hydrocarbon crude oil with an oil soluble catalyst to form a reactant mixture, wherein the catalyst is capable of hydrogenating at least a portion of the heavy hydrocarbon crude oil;

(b) heating and mixing the reactant mixture for a sufficient amount of time to form a heavy hydrocarbon oil dispersion, wherein at least a portion of the heavy hydrocarbon crude oil in the heavy hydrocarbon oil dispersion undergoes shearing;

(c) reacting the heavy hydrocarbon oil dispersion in the presence of a hydrogen containing gas in an upgrading unit under relatively low hydrogen partial pressure of less than approximately 3.0 MPa for a sufficient amount of time to form a product stream, the product stream comprising a light oil component, a heavy crude oil residue, and a light hydrocarbon gas, wherein the light oil component has an API gravity greater than the API gravity of the heavy hydrocarbon crude oil;

(d) separating the product stream into a light hydrocarbon gas stream, a light oil stream, and a heavy crude oil residue stream; and (e) injecting a portion of the light hydrocarbon gas stream in a fluid catalytic cracking unit to produce streams containing hydrogen and at least one olefin.

2. The process of claim 1, further comprising contacting the catalyst with hydrogen sulfide during or prior to step (c), such that at least a portion of the catalyst is sulfated.

3. The process of claim 2, wherein the heavy hydrocarbon oil dispersion is formed prior to contacting the catalyst with hydrogen sulfide.

4. The process of claim 1, wherein the hydrogen containing gas includes at least 90 percent by weight hydrogen.

5. The process of claim 1, wherein the catalyst is at least partially dispersible in the heavy hydrocarbon crude oil and includes a transition metal selected from elements in Group V, Group VI, and Group VIII of the Periodic Table, and mixtures thereof.

6. The process of claim 5, wherein the catalyst is a transition metal compound in which the metal is selected from the group consisting of molybdenum, iron, cobalt, nickel, and combinations thereof.

7. The process of claim 1, wherein the catalyst is selected from the group consisting of iron naphthenate, molybdenum naphthenate, an organomolybdenum complex of organic amide in petroleum process oil, ammonium molybdate, molybdenum 2-ethylhexanoate, molybdenum glycol ether mixtures, and combinations thereof.

8. The process of claim 1, wherein the heavy hydrocarbon crude oil and the catalyst are mixed using a rotor stator system.

9. The process of claim 1, wherein the heavy hydrocarbon crude oil and the catalyst are mixed using an ultrasonic device.

10. The process of claim 1, wherein step (c) is conducted at a temperature in the range from about 400° C. to about 500° C. and at a pressure in the range from about 500 psi to about 2200 psi.

11. The process of claim 1, wherein the heavy hydrocarbon crude oil includes a first sulfur concentration and the light oil includes a second sulfur concentration and, wherein the second sulfur concentration is less than the first sulfur concentration.

12. The process of claim 1, wherein the light oil stream is further refined to form a fuel.

13. The process of claim 12, wherein the fuel is homogenized, thereby increasing stability of the fuel.

14. The process of claim 1, further comprising recycling at least a portion of the heavy crude oil residue into the process for further refining by combining the recycled portion of the heavy crude oil residue with the reaction mixture.

15. The process of claim 1, further comprising processing at least a portion of the heavy crude oil residue to form carbon fiber.

16. The process of claim 1, further comprising processing at least a portion of the heavy crude oil residue to form asphalt.

17. The process of claim 16, wherein the step of processing at least a portion of the heavy crude oil residue is conducted in the presence of sulfur to form asphalt.

18. The process of claim 1, further comprising the step of:

Separating a gas by-product stream from the upgrading unit to create at least one off-gas.

19. The process of claim 18, wherein the at least one off-gas comprises a hydrogen containing gas.

20. The process of claim 19, further comprising recycling the at least one off-gas into the process at a point at or upstream of the upgrading unit.

21. The process of claim 19, wherein the hydrogen containing gas comprises at least 90 percent by weight hydrogen.

22. The process of claim 19, wherein the hydrogen containing gas comprises hydrogen sulfide.

23. The process of claim 18, further comprising the step of:

injecting at least one of the at least one off-gases into a reservoir.

24. The process of claim 1, further comprising the step of:

hydrogenating a portion of the product stream, the portion having a boiling below 1000° F.

25. The process of claim 1, wherein the heavy hydrocarbon crude oil includes an oil selected from the group consisting of whole crude oil, desalted crude oil, topped crude oil, deasphalted oil, vacuum gas oils, petroleum residua, dispersion of crude oil, dispersions of heavy hydrocarbon fractions of crude oils, and mixtures thereof.

26. The process of claim 1, wherein the catalyst is a hydrotreating catalyst.

27. The process of claim 1, wherein the catalyst is sulfated in the reactant mixture.

28. The process of claim 1, wherein the catalyst is sulfated prior to being combined with the heavy hydrocarbon crude oil.

29. The process of claim 1, wherein the catalyst is sulfated in situ by adding a decomposable sulfur compound to the reactant mixture prior to mixing and heating the reactant mixture.

30. The process of claim 1, further comprising the step of:

heat soaking the light oil.

31. The process of claim 1, wherein the catalyst further comprises at least one catalytic promoter.

32. The process of claim 31, wherein the catalytic promoter is selected from the group consisting of phosphorus, silica, zeolites, alkali and alkaline earth metal oxides, and combinations thereof.

33. A sulfur containing crude oil desulphurization process comprising:

(a) hydrodesulfurizing a sulfur containing crude oil feed using an oil soluble catalyst in a crude desulphurization unit to obtain a desulfurized crude oil;

(b) separating the desulfurized crude oil into a light gas fraction, a light oil fraction, a heavy oil fraction, and a residual fraction;

(c) passing a portion of the light oil fraction and a portion of the heavy oil fraction in combination with hydrogen to a secondary upgrading unit reaction zone;

(d) hydrocracking the portion of the light oil fraction and the portion of the heavy oil fraction in the secondary upgrading unit reaction zone to produce an effluent;

(e) passing a portion of the residual fraction and a portion of the light gas fraction through a fluid catalytic cracking unit; and (f) cracking the portion of the residual fraction and the portion of the light gas fraction in the fluid catalytic cracking unit to produce at least one light olefin and at least one aromatic product.

* * * * *

UNITED STATES PATENT AND TRADEMARK OFFICE

CERTIFICATE OF CORRECTION

PATENT NO. : 7,790,018 B2
APPLICATION NO. : 11/431323
DATED : September 7, 2010
INVENTOR(S) : M. Rashid Khan It is certified that error appears in the above-identified patent and that said Letters Patent is hereby corrected as shown below:

Title page, item [75]

Inventor: Rashid M. Khan, Dhahran Camp (SA) should read --Inventor: M. Rashid Khan, Dhahran Camp (SA)--

Signed and Sealed this

Twenty-third Day of November, 2010

David J. Kappos

David J. Kappos
*Director of the United States Patent and Trademark Office*